US012806472B2

(12) United States Patent
Yu

(10) Patent No.: US 12,806,472 B2
(45) Date of Patent: Nov. 24, 2026

(54) EXERCISE DATA ESTIMATION METHOD, DEVICE, AND COMPUTER-READABLE STORAGE MEDIUM

(71) Applicant: BOMDIC INC., New Taipei City (TW)

(72) Inventor: Hsin-Ju Yu, New Taipei City (TW)

(73) Assignee: BOMDIC INC., New Taipei City (TW)

( * ) Notice: Subject to any disclaimer, the term of this patent is extended or adjusted under 35 U.S.C. 154(b) by 897 days.

(21) Appl. No.: 18/192,658

(22) Filed: Mar. 30, 2023

(65) Prior Publication Data

US 2024/0325821 A1 Oct. 3, 2024

(51) Int. Cl.
*A63B 24/00* (2006.01)
*A63B 69/16* (2006.01)

(52) U.S. Cl.
CPC ..... *A63B 24/0062* (2013.01); *A63B 69/16* (2013.01); *A63B 2220/50* (2013.01); *A63B 2220/62* (2013.01); *A63B 2220/833* (2013.01); *A63B 2230/06* (2013.01)

(58) Field of Classification Search
CPC ..... A63B 24/00–0087; A63B 2024/009–0096
See application file for complete search history.

(56) References Cited

U.S. PATENT DOCUMENTS

| | | | | |
|---|---|---|---|---|
| 9,737,761 | B1 * | 8/2017 | Sivaraj | A61B 5/222 |
| 9,855,463 | B2 * | 1/2018 | Erkkila | G16H 10/60 |
| 12,285,650 | B2 * | 4/2025 | Mohrman | A61B 5/1118 |
| 12,472,402 | B2 * | 11/2025 | Sankai | G16H 20/30 |
| 2005/0164832 | A1 * | 7/2005 | Maschke | A63B 69/0028 482/8 |

(Continued)

FOREIGN PATENT DOCUMENTS

| | | | | |
|---|---|---|---|---|
| CN | 104665788 B | * | 10/2017 | A63B 23/18 |
| CN | 114947789 A | * | 8/2022 | A61B 5/024 |

(Continued)

*Primary Examiner* — Nyca T Nguyen
(74) *Attorney, Agent, or Firm* — Meunier Carlin & Curfman LLC

(57) ABSTRACT

Provided are an exercise data estimation method, device, and a computer-readable storage medium. An exercise data set corresponding to a $t^{th}$ time point is obtained, where the exercise data set corresponding to the $t^{th}$ time point includes an exercise heart rate and an exercise power corresponding to the $t^{th}$ time point. A a heart rate ratio corresponding to the $t^{th}$ time point is determined based on the exercise heart rate corresponding to the $t^{th}$ time point. For the exercise data set being determined to be a valid exercise data set, a power estimation model is updated based on the exercise data set and the heart rate ratio corresponding to the $t^{th}$ time point. A maximum aerobic power corresponding to the $t^{th}$ time point is estimated based on the power estimation model.

20 Claims, 3 Drawing Sheets

(56) References Cited

U.S. PATENT DOCUMENTS

| | | | | |
|---|---|---|---|---|
| 2015/0250417 | A1* | 9/2015 | Cheng | A61B 5/4866 600/509 |
| 2016/0066835 | A1* | 3/2016 | He | A63B 24/0087 482/4 |
| 2016/0256058 | A1* | 9/2016 | Pham | A61B 5/02438 |
| 2017/0274249 | A1* | 9/2017 | Moebius | A63B 23/0405 |
| 2021/0161466 | A1* | 6/2021 | Kurunmäki | A61B 5/4866 |
| 2022/0047222 | A1* | 2/2022 | Yeh | G16H 20/30 |
| 2023/0023736 | A1* | 1/2023 | Chen | A61B 5/0205 |

FOREIGN PATENT DOCUMENTS

| | | | | | |
|---|---|---|---|---|---|
| DE | 102012004698 | B3 | * | 7/2013 | A61B 5/6895 |
| EP | 3146896 | B1 | * | 4/2020 | A61B 5/112 |
| GB | 2532455 | A | * | 5/2016 | A61B 5/681 |
| WO | WO-2014171983 | A1 | * | 10/2014 | A63B 24/0075 |
| WO | WO-2016044831 | A1 | * | 3/2016 | A63B 24/0062 |
| WO | WO-2018209144 | A1 | * | 11/2018 | A63B 21/4025 |

* cited by examiner

EXERCISE DATA ESTIMATION METHOD, DEVICE, AND COMPUTER-READABLE STORAGE MEDIUM

BACKGROUND

Technical Field

This disclosure relates to an exercise monitoring technology, and particularly to an exercise data estimation method, device, and a computer-readable storage medium.

Description of Related Art

For athletes, Maximum Aerobic Power (MAP) can be an important indicator of their physical ability. Therefore, if a technique can be developed to accurately estimate the maximum aerobic power of an athlete, it should be effective in improving the mastery of the physical ability of the athlete.

SUMMARY

In view of this, the disclosure provides an exercise data estimation method, device, and a computer-readable storage medium, capable of being used to solve the above-mentioned technical problems.

An embodiment of the disclosure provides an exercise data estimation method adapted to an exercise data estimation device, including that an exercise data set corresponding to a $t^{th}$ time point is obtained, where the exercise data set corresponding to the $t^{th}$ time point includes an exercise heart rate and an exercise power corresponding to the $t^{th}$ time point, and t is an index value; a heart rate ratio corresponding to the $t^{th}$ time point is determined based on the exercise heart rate corresponding to the $t^{th}$ time point; in response to determining that the exercise data set and the heart rate ratio corresponding to the $t^{th}$ time point match multiple predetermined conditions, the exercise data set is determined to be a valid exercise data set, and a power estimation model is updated based on the exercise data set and the heart rate ratio corresponding to the $t^{th}$ time point; and a maximum aerobic power corresponding to the $t^{th}$ time point is estimated based on the power estimation model.

An embodiment of the disclosure provides an exercise data estimation device including a storage circuit and a processor. The storage circuit stores a program code. The processor is coupled to the storage circuit and accesses the program code to obtain an exercise data set corresponding to a $t^{th}$ time point, where the exercise data set corresponding to the $t^{th}$ time point includes an exercise heart rate and an exercise power corresponding to the $t^{th}$ time point, and t is an index value; determine a heart rate ratio corresponding to the $t^{th}$ time point based on the exercise heart rate corresponding to the $t^{th}$ time point; in response to determining that the exercise data set and the heart rate ratio corresponding to the $t^{th}$ time point match multiple predetermined conditions, determine that the exercise data set is a valid exercise data set, and update a power estimation model based on the exercise data set and the heart rate ratio corresponding to the $t^{th}$ time point; and estimate a maximum aerobic power corresponding to the $t^{th}$ time point based on the power estimation model.

An embodiment of the disclosure provides a computer-readable storage medium recording an executable computer program. The executable computer program is loaded by an exercise data estimation device to obtain an exercise data set corresponding to a $t^{th}$ time point, where the exercise data set corresponding to the $t^{th}$ time point includes an exercise heart rate and an exercise power corresponding to the $t^{th}$ time point, and t is an index value; determine a heart rate ratio corresponding to the $t^{th}$ time point based on the exercise heart rate corresponding to the $t^{th}$ time point; in response to determining that the exercise data set and the heart rate ratio corresponding to the $t^{th}$ time point match multiple predetermined conditions, determine that the exercise data set is a valid exercise data set, and update a power estimation model based on the exercise data set and the heart rate ratio corresponding to the $t^{th}$ time point; and estimate a maximum aerobic power corresponding to the $t^{th}$ time point based on the power estimation model.

DESCRIPTION OF THE EMBODIMENTS

Figure 1:
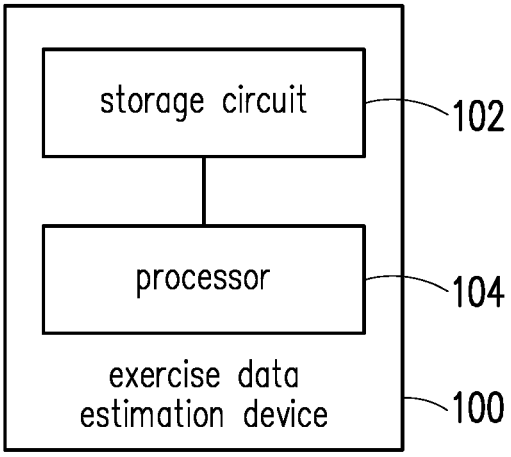
FIG. 1 is a schematic diagram of an exercise data estimation device illustrated according to an embodiment of the disclosure.

Please refer to FIG. 1, which is a schematic diagram of an exercise data estimation device illustrated according to an embodiment of the disclosure. In different embodiments, an exercise data estimation device 100 may be implemented as various types of smart devices and/or computer devices, but not limited thereto.

In FIG. 1, the exercise data estimation device 100 includes a storage circuit 102 and a processor 104. The storage circuit 102 may be any type of fixed or removable random access memory (RAM), read-only memory (ROM), flash memory, hard drive, or a combination of these devices, which may be used to record multiple program codes or modules.

The processor 104 is coupled to storage circuit 102 and may be a general-purpose processor, special-purpose processor, traditional processor, digital signal processor, multiple microprocessors, one or more microprocessors with integrated digital signal processor cores, controllers, microcontrollers, application specific integrated circuit (ASIC), field programmable gate array (FPGA) circuit, any other type of integrated circuit, state machine, processor based on Advanced RISC Machine (ARM), and similar products.

In an embodiment of the disclosure, the processor 104 may access the modules and program codes recorded in the storage circuit 102 to implement the exercise data estimation method proposed in the disclosure, as detailed below.

Figure 2:
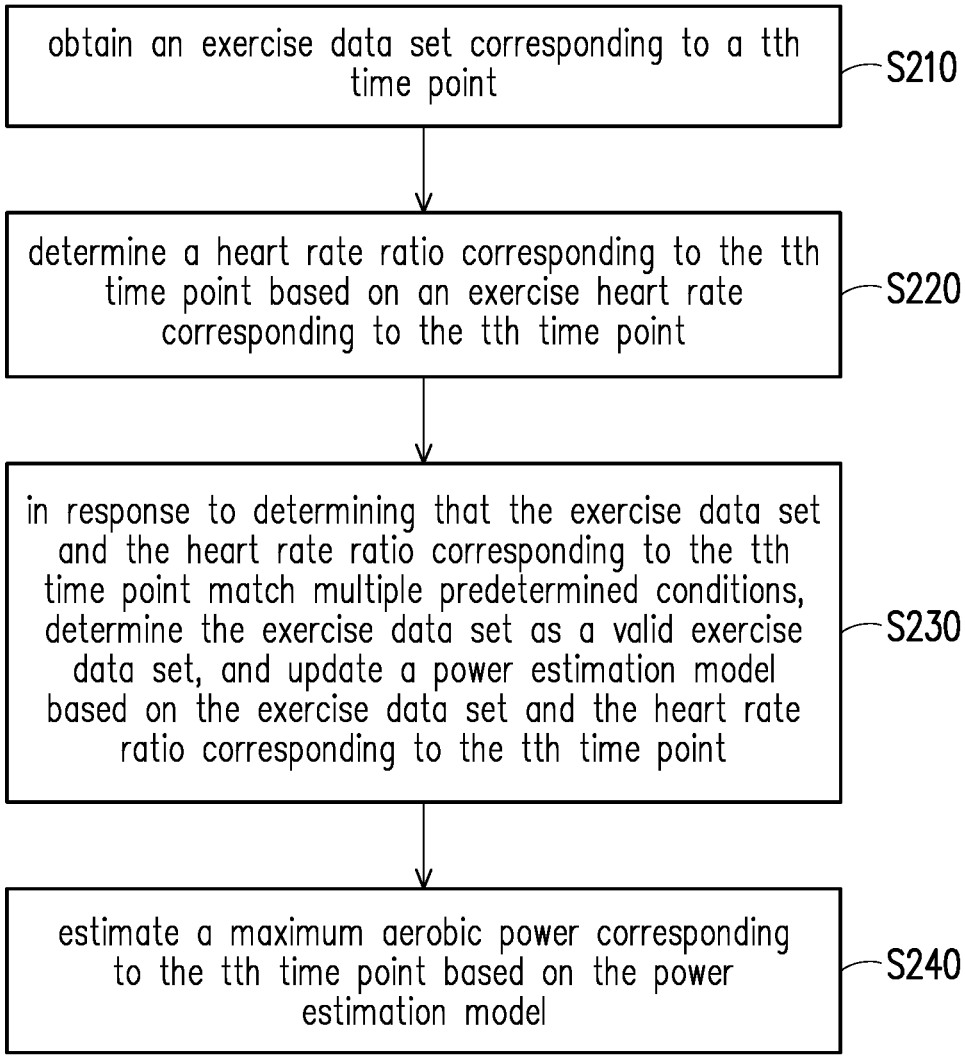
FIG. 2 is a flowchart of an exercise data estimation method illustrated according to an embodiment of the disclosure.

Please refer to FIG. 2, which is a flowchart of an exercise data estimation method illustrated according to an embodiment of the disclosure. The method of this embodiment may be performed by the exercise data estimation device 100 shown in FIG. 1, and details of each step of FIG. 2 are illustrated below with components shown in FIG. 1.

Firstly, in step S210, the processor 104 obtains an exercise data set corresponding to a $t^{th}$ time point, where the exercise data set corresponding to the $t^{th}$ time point includes an exercise heart rate (expressed in hr) and an exercise power (expressed in pr) corresponding to the $t^{th}$ time point, and t is an index value.

In an embodiment of the disclosure, the exercise heart rate (hr) corresponding to the $t^{th}$ time point is measured from a user riding on a bicycle (e.g., a heart rate of the user at a t time point), which may be measured by a heart rate sensor on the exercise data estimation device 100 or by a heart rate sensor separately worn by the user and connected to the exercise data estimation device 100. The exercise power (pr) corresponding to the $t^{th}$ time point is, for example, a pedaling power applied to the bicycle by the user at the t time point, but not limited thereto. In other embodiments, the exercise heart rate (hr) and the exercise power (pr) may also be a heart rate and/or power measured during other exercises performed by the user, such as rowing (rowing machine), running.

In a first embodiment, the exercise power pr (e.g., pedaling power) may be measured from a power meter disposed on the bicycle. For example, the power meter may be disposed on a crank, chainwheel, or pedal of the bicycle to measure the pedaling power output from the user while pedaling the bicycle, but not limited thereto.

In the second embodiment, the exercise power pr (e.g., pedaling power) may also be estimated through other means. For example, the processor 104 may, for example, estimate the exercise power pr corresponding to the $t^{th}$ time point based on frictional force, a gravitational component, and air resistance corresponding to the bicycle, and kinetic energy and a movement speed of the bicycle.

In the second embodiment, the exercise power corresponding to the $t^{th}$ time point is expressed as:

$$Pr_{pred} = Pr_{workenergy} + (F_{frictional} + F_g + F_{air}) * sp,$$

where $Pr_{workenergy}$ is the kinetic energy of the bicycle at the $t^{th}$ time point, sp is the speed of the bicycle at the $t^{th}$ time point, which may be sensed and calculated by a positioning system, a wheel rotation sensor, etc., $F_{frictional}$ is the frictional force corresponding to the bicycle at the $t^{th}$ time point, $F_g$ is the gravitational component corresponding to the bicycle (at the $t^{th}$ time point), and $F_{air}$ is the air resistance corresponding to the bicycle at the $t^{th}$ time point.

In an embodiment, $F_{frictional}$ may be expressed as:

$$F_{frictional} = m_{total} * coef_{frictional},$$

where $m_{total}$ is preferably a sum of a weight of the bicycle, a weight of the user riding on the bicycle, and a weight of equipment installed on the bicycle. The weight of the bicycle, the weight of the user riding on the bicycle, and the weight of the equipment installed on the bicycle may be entered by the user or synchronized with other databases respectively. $coef_{frictional}$ is a coefficient of friction of a surface (e.g., the ground) on which the bicycle travels.

In an embodiment, $F_g$ may be expressed as:

$$F_g = m_{total} * \sin\theta,$$

where θ is an angle between the surface on which the bicycle travels and the horizontal surface, and sin θ may be, for example, obtained by dividing a vertical height change of the bicycle in a unit of time by a traveling distance of the surface on which the bicycle travels, but not limited thereto.

In an embodiment, $F_{air}$ may be expressed as:

$$F_{air} = 0.5 * \rho * C_d * \text{Area}_{drag} * (sp + sp_{wind})^2,$$

where $\text{Area}_{drag}$ is a windward area of the bicycle (and the user riding thereon) (which may, for example, be regarded as a fixed value or derived from the weight of the user), p is an air density (which may, for example, also be regarded as a fixed value or may be taken from a database), $C_d$ is a wind resistance coefficient (which may, for example, also be regarded as a fixed value or may be taken from a database), and $sp_{wind}$ is a wind speed (which may, for example, also be regarded as a fixed value or may be taken from a database).

In an embodiment, $Pr_{workenergy}$ may be expressed as:

$$Pr_{workenergy} = F_{net} * sp = 0.5 * \left(m_{total} + \frac{I}{r_{wheel}^2}\right) * (sp^2 - sp_{last}^2),$$

where $F_{net}$ is net force of the bicycle; $r_{wheel}$ is a radius of a bicycle wheel, which may be entered by the user or taken from the database; $sp_{last}$ is a speed of the bicycle at a $t-1^{th}$ time point.

In an embodiment, $F_{net}$ may be expressed as:

$$F_{net} = F_{rider} - (F_{frictional} + F_g + F_{air}),$$

where $F_{rider}$ is force of the user pedaling the bicycle.

In step S220, the processor 104 determines a heart rate ratio corresponding to the $t^{th}$ time point based on the exercise heart rate corresponding to the $t^{th}$ time point.

In an embodiment, the processor 104 may, for example, estimate the heart rate ratio corresponding to the $t^{th}$ time point based on the following formula, e.g., a heart rate reserve ratio:

$$\text{hrr_t} = \frac{hr - hr_{rest}}{hr_{max} - hr_{rest}},$$

where $hr_{rest}$ is a resting heart rate of the user, $hr_{max}$ is a maximum heart rate of the user. The resting heart rate and the maximum heart rate of the user may be entered by the user, measured by the heart rate sensor, or obtained from a database.

After obtaining the exercise data set and the heart rate ratio (i.e., hrr_t) corresponding to the $t^{th}$ time point, in an embodiment, the processor 104 may determine whether the exercise data set and the heart rate ratio corresponding to the $t^{th}$ time point match multiple predetermined conditions as a valid exercise data set that represents that the user is pedaling and riding.

In an embodiment, the processor 104 may obtain multiple historical exercise data sets corresponding to a first time point to a $t-1^{th}$ time point, where a $k^{th}$ historical exercise data set of the historical exercise data sets includes a historical exercise heart rate and a historical exercise power corresponding to a $k^{th}$ time point, (which may be interpreted as a measured exercise heart rate and exercise power of the user at the $k^{th}$ time point), $1 \le k \le (t-1)$.

Afterwards, the processor 104 may determine whether t is not less than a first predetermined quantity threshold (e.g., 5). If so, this means that collected exercise data sets (i.e., the historical exercise data sets and the exercise data set corresponding to the $t^{th}$ time point) are sufficient for subsequent processing, so that the processor 104 may estimate multiple parameter thresholds based on the historical exercise data sets, and determine at least one of the predetermined conditions accordingly. On the other hand, if the processor 104 determines that t is less than the first predetermined quantity threshold, this means that the collected exercise data sets are still insufficient; thus the processor 104 may update a power estimation model based on the exercise data set corresponding to the $t^{th}$ time point and continue to collect the exercise data set, and the relevant details will be described later.

In an embodiment, after determining that t is not less than the first predetermined quantity threshold, the processor 104 may, for example, determine the predetermined conditions based on the following methods. Specifically, the processor 104 may estimate a heart rate ratio statistical value based on the historical exercise heart rate of each of the historical exercise data sets.

For example, for the historical exercise heart rate at the $k^{th}$ time point, the processor 104 may, for example, estimate a corresponding historical heart rate ratio based on the following formula:

$$\text{hrr_k} = \frac{hr_k - hr_{rest}}{hr_{max} - hr_{rest}},$$

where $hr_k$ is the historical exercise heart rate of the user at the $k^{th}$ time point, $hr_{rest}$ is the resting heart rate of the user, and $hr_{max}$ is the maximum heart rate of the user.

After determining the historical heart rate ratio corresponding to each of the historical exercise heart rate, the processor 104 may take a statistical value for the historical heart rate ratio of the each of the historical exercise heart rate and use the statistical value as the heart rate ratio statistical value. In an embodiment, the processor 104 may, for example, take an average value for the historical heart rate ratio of the each of the historical exercise heart rate and use the average value as the heart rate ratio statistic value (expressed as hr_mean), but may not be limited thereto.

In an embodiment, the processor 104 may estimate a power statistical value based on the historical exercise power of the each of the historical exercise data sets. For example, the processor 104 may take a statistical value for each of the historical exercise power and use the statistical value as the power statistical value, but not limited thereto. In an embodiment, the processor 104 may take an average value for each of the historical exercise power and use the average value as the power statistical value (expressed as pr_mean), but may not be limited thereto.

In an embodiment, the predetermined conditions include one or more of the following conditions: (1) the heart rate ratio corresponding to the $t^{th}$ time point being greater than the heart rate ratio statistical value hr_mean and a heart rate ratio lower limit value (e.g., 0.5); (2) the exercise power pr corresponding to the $t^{th}$ time point being greater than the power statistical value pr_mean and a power lower limit value (e.g., 0), as a valid exercise data set that represents that the user did indeed pedal the bicycle and output power at the $t^{th}$ time point.

In an embodiment, the processor 104 may determine a power estimation model based on the historical exercise data sets corresponding to the first time point to the t−1th time point.

Figure 3:
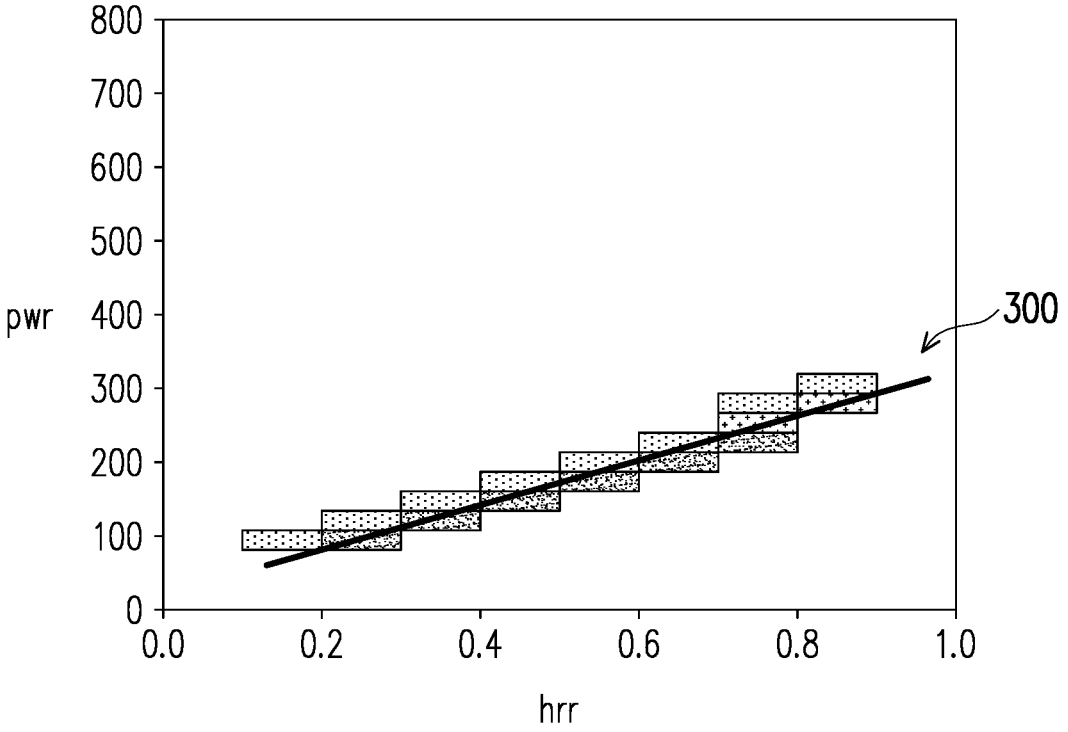
FIG. 3 is a schematic diagram of a power estimation model for determining according to an embodiment of the disclosure.

Please refer to FIG. 3, which is a schematic diagram of a power estimation model for determining according to an embodiment of the disclosure. The historical heart rate ratio and the historical exercise power corresponding to the each of the historical exercise heart rate are shown in FIG. 3. As shown in FIG. 3, the processor 104 may, after determining the heart rate ratio corresponding to the each of the historical exercise heart rate, perform a linear regression operation based on these data to determine relevant model coefficients of a power estimation model 300.

In FIG. 3, the power estimation model 300 may be expressed as:

$$pwr = a * hrr + c,$$

where pwr is an estimated power, hrr is a specific heart rate ratio, and a and c are multiple model coefficients of the power estimation model 300.

Based on this, the processor 104 may, after obtaining a specific heart rate ratio, substitute the specific heart rate ratio into the above formula to estimate the estimated power corresponding to the specific heart rate ratio, but not limited thereto.

In an embodiment, after obtaining the exercise power pr corresponding to the $t^{th}$ time point, the processor 104 may also determine a predicted exercise power (expressed as pr') corresponding to the $t^{th}$ time point based on the exercise heart rate hr corresponding to the $t^{th}$ time point. Afterwards, the processor 104 may obtain a specific error (expressed as err_LR) between the exercise power pr and the predicted exercise power pr' corresponding to the $t^{th}$ time point. In an embodiment, the specific error err_LR may be expressed as |pr-pr'|, but is not limited thereto. In an embodiment, the predetermined conditions may also include: (3) the specific error is less than an error threshold (e.g., 0.4).

In an embodiment, the processor 104 may determine that the exercise data set corresponding to the $t^{th}$ time point satisfies the predetermined conditions as a valid exercise data set when, but not limited to, (1) the heart rate ratio corresponding to the $t^{th}$ time point is greater than the heart rate ratio statistical value hr_mean and the heart rate ratio lower limit value (e.g., 0.5); (2) the exercise power pr corresponding to the $t^{th}$ time point is greater than the power statistical value pr_mean and the power lower limit value (e.g., 0); and (3) the specific error is less than the error threshold.

In addition, as mentioned earlier, if the processor 104 determines that t is less than the first predetermined quantity threshold (e.g., 5), the processor 104 may update the power estimation model based on the exercise data set corresponding to the $t^{th}$ time point.

For example, when obtaining the exercise data set and heart rate ratio corresponding to the $t^{th}$ time point, the processor 104 may be interpreted to have determined the relevant model coefficients of the power estimation model based on the historical exercise data sets and the historical heart rate ratio corresponding to the first time point to the $t-1^{th}$ time point. Based on this, the processor 104 may update the model coefficients again based on the exercise data set and the heart rate ratio corresponding to the $t^{th}$ time point.

In an embodiment, the processor 104 may perform a linear regression based on the historical heart rate ratio, the historical exercise power of the each of the historical exercise data sets, and the exercise power and the heart rate ratio corresponding to the $t^{th}$ time point to determine the relevant model coefficients of the power estimation model.

In an embodiment, the processor 104 may be interpreted as performing a linear regression based on correspondence between the heart rate ratios and the (historical) exercise power corresponding to the first time point to the $t^{th}$ time point after obtaining the (historical) heart rate ratio corresponding to the first time point to the $t^{th}$ time point, thereby determining the corresponding relevant model coefficients of the power estimation model, but not limited thereto. From another perspective, when t is less than the first predetermined quantity threshold, the processor 104 may be interpreted as not separately determining whether the exercise data set corresponding to the $t^{th}$ time point satisfies the predetermined conditions, but directly updating the relevant model coefficients of the power estimation model based on the exercise data set corresponding to the $t^{th}$ time point, but not limited thereto.

On the other hand, when t is not less than the first predetermined quantity threshold, the processor 104 may accordingly determine the predetermined conditions and determine whether the exercise data set and the heart rate ratio corresponding to the $t^{th}$ time point match the predetermined conditions.

Please refer to FIG. 2 again. In step S230, in response to determining that the exercise data set and the heart rate ratio corresponding to the $t^{th}$ time point match the predetermined conditions, the processor 104 determines the exercise data set as a valid exercise data set, and update the power estimation model based on the exercise data set and the heart rate ratio corresponding to the $t^{th}$ time point.

In an embodiment, a method for updating (the relevant model coefficients of) the power estimation model by the processor 104 may be referred to the description in the previous embodiments, and will not be repeated in the following.

In step S230, since the processor 104 updates the power estimation model only after determining that the predetermined conditions are met, it is possible to avoid the result of updating the power estimation model being affected by abnormalities in collected exercise data (e.g., below a lower limit or the heart rate ratio of the heart rate ratio statistical value hr_mean and/or below a lower limit or the exercise power pr of the power statistical value pr_mean, etc.).

Afterwards, in step S240, the processor 104 estimates a maximum aerobic power corresponding to the $t^{th}$ time point based on the power estimation model.

In an embodiment, where the power estimation model is expressed as "pwr=a*hrr+c", the processor 104 may, for example, set the specific heart rate ratio (i.e., hrr) as a reference value and substitute the specific heart rate ratio set as the reference value into the power estimation model. Afterwards, the processor 104 may determine the corresponding estimated power as the maximum aerobic power corresponding to the $t^{th}$ time point.

In an embodiment, the reference value may, for example, be set to 1 (which may be interpreted as corresponding to the maximum heart rate), and the processor 104 may, after substituting the specific heart rate ratio set to 1 into the power estimation model, use the corresponding estimated power (i.e., a+c) as a maximum aerobic power (expressed as P) corresponding to the $t^{th}$ time point, but may not be limited thereto.

In an embodiment, after obtaining the maximum aerobic power P corresponding to the $t^{th}$ time point, the processor 104 may estimate functional threshold power (FTP) of the user based on multiple physiological characteristics (e.g., gender, height, weight, age, etc.) of the user and the maximum aerobic power P corresponding to the $t^{th}$ time point.

In an embodiment, FTP may be expressed as:

$$FTP = w_1 * G + w_2 * H + w_3 * W + w_4 * P + w_5 * A + w_6,$$

where G is the gender of the user (male is 1, female is 0), H is the height of the user (in meters), W is the weight of the user (in kilograms), A is the age of the user; $w_1$~$w_6$ is coefficients, which may be determined by the designer according to the needs or situation.

In an embodiment, the processor 104 may determine a specific factor (e.g. FTP/W) based on the functional threshold power and the weight of the user. Then, the processor 104 may determine whether the specific factor falls within a predetermined range (e.g. between 1 and 6, as may be determined by the designer depending on the situation) to determine whether a resulting value of the determined specific factor matches a value that a normal user can generate; and whether a quantity of the valid exercise data set is greater than a second predetermined quantity threshold (which may be set to a sufficiently large value, e.g., 180, depending on the needs of the designer) to determine whether the collected exercise data sets are sufficient.

In an embodiment, if the specific factor falls within the predetermined range and t is greater than the second predetermined quantity threshold, this means that the processor 104 has collected data for a long enough time and that the FTP of the user is not abnormal. In this case, the processor 104 may determine that the FTP is a valid value, and may then provide the FTP to the user for reference. In another embodiment, the new FTP value may also be used as the basis for updating the previous FTP value.

On the other hand, if the specific factor does not fall within the predetermined range or if t is not greater than the second predetermined quantity threshold, this means that the processor 104 is not collecting data for a long enough time or that the FTP of the user is abnormal. In this case, the processor 104 may determine that the FTP is invalid and further may not provide the FTP to the user for reference.

In addition, the disclosure further provides a computer-readable storage medium for performing an exercise data estimation method. The computer-readable storage medium is composed of multiple program instructions (e.g., setup program instructions and deployment program instructions) implemented therein. The program instructions may be loaded into and performed by the exercise data estimation device 100 to perform the exercise data estimation method and functions of the exercise data estimation device 100.

In summary, the method proposed in this embodiment of the disclosure may be adapted to update/determine the power estimation model after obtaining the exercise heart rate and the exercise power corresponding to the $t^{th}$ time point, and use the power estimation model to estimate the maximum aerobic power corresponding to the $t^{th}$ time point. In addition, this embodiment of the disclosure proposes a mechanism for estimating the functional threshold power based on the maximum aerobic power. In this way, a more accurate estimation of physical ability of an athlete may be made, which in turn improves mastery of the physical ability of the athlete and allows the relevant personnel to arrange a more complete and effective training program for the athlete.

Although the disclosure has been disclosed by way of embodiment as above, it is not intended to limit the disclosure, and any person skilled in the art may, without departing from the spirit and scope of the disclosure, make some modifications and embellishments, so that the scope of protection of the disclosure shall be subject to the scope of the following claims.

What is claimed is:

1. An exercise data estimation method adapted to an exercise data estimation device, the exercise data estimation device comprising a processor, a storage circuit coupled to the processor and storing program code executed by the processor, a heart rate sensor coupled to the processor, and a power meter coupled to the processor, and the method comprising:

the processor obtaining a plurality of historical exercise data sets corresponding to a first time point to a $t-1^{th}$ time point, wherein a $k^{th}$ historical exercise data set of the historical exercise data sets comprises a historical exercise heart rate and a historical exercise power corresponding to a $k^{th}$ time point, $1 \leq k \leq (t-1)$, and the processor obtains from the heart rate sensor the historical exercise heart rate corresponding to the $k^{th}$ time point measured by the heart rate sensor on the exercise data estimation device worn by a user riding on a bicycle, and obtains the historical exercise power corresponding to the $k^{th}$ time point from the power meter disposed on the bicycle being ridden by the user;

the processor obtaining an exercise data set corresponding to a $t^{th}$ time point, wherein the exercise data set corresponding to the $t^{th}$ time point comprises an exercise heart rate and an exercise power corresponding to the $t^{th}$ time point, t is an index value, and the processor obtains from the heart rate sensor the exercise the heart rate corresponding to the $t^{th}$ time point measured by the heart rate sensor on the exercise data estimation device worn by the user riding on the bicycle, and obtains the exercise power corresponding to the $t^{th}$ time point from the power meter disposed on the bicycle being ridden by the user;

the processor determining a heart rate ratio corresponding to the $t^{th}$ time point based on the exercise heart rate corresponding to the $t^{th}$ time point;

in response to determining that t is not less than a first predetermined quantity threshold, the processor estimating a plurality of parameter thresholds based on the historical exercise data sets, determining at least one of a plurality of predetermined conditions based on the plurality of parameter thresholds, and in response to determining that the exercise data set and the heart rate ratio corresponding to the $t^{th}$ time point match the plurality of predetermined conditions, determining that the exercise data set is a valid exercise data set representing that the user is pedaling and riding the bicycle, and updating a power estimation model based on the exercise data set and the heart rate ratio corresponding to the $t^{th}$ time point;

in response to determining that t is less than the first predetermined quantity threshold, the processor updating the power estimation model based on the exercise data set corresponding to the $t^{th}$ time point, and continuing to collect the exercise data set from the heart rate sensor and the power meter for subsequent processing; and the processor estimating a maximum aerobic power corresponding to the $t^{th}$ time point based on the power estimation model.

2. The method according to claim 1, wherein the parameter thresholds comprise a heart rate ratio statistical value and a power statistical value, and the predetermined conditions comprise one or more of the following conditions:

the heart rate ratio corresponding to the $t^{th}$ time point being greater than the heart rate ratio statistical value and a heart rate ratio lower limit value;

the exercise power corresponding to the $t^{th}$ time point being greater than the power statistical value and a power lower limit value.

3. The method according to claim 2 further comprising:

determining a predicted exercise power corresponding to the $t^{th}$ time point based on the exercise heart rate corresponding to the $t^{th}$ time point;

obtaining a specific error between the exercise power and the predicted exercise power corresponding to the $t^{th}$ time point, and the predetermined conditions further comprising:

the specific error being less than an error threshold.

4. The method according to claim 1, wherein the power estimation model is expressed as:

$$pwr=a*hrr+c$$

where pwr is an estimated power, hrr is a specific heart rate ratio, and a and c are a plurality of model coefficients of the power estimation model.

5. The method according to claim 4, wherein estimating the maximum aerobic power corresponding to the $t^{th}$ time point based on the power estimation model comprises:

substituting the specific heart rate ratio set as a reference value into the power estimation model, and determining the corresponding estimated power as the maximum aerobic power corresponding to the $t^{th}$ time point.

6. The method according to claim 4, wherein updating the power estimation model based on the exercise data set and the heart rate ratio corresponding to the $t^{th}$ time point comprises:

updating the model coefficients of the power estimation model based on the exercise data set and the heart rate ratio corresponding to the $t^{th}$ time point.

7. The method according to claim 6, wherein updating the model coefficients of the power estimation model based on the exercise data set and the heart rate ratio corresponding to the $t^{th}$ time point comprises:

determining a plurality of historical heart rate ratios, wherein the historical heart rate ratios comprise the heart rate ratio corresponding to the historical exercise heart rate of each of the historical exercise data sets;

performing a linear regression operation based on the historical heart rate ratios, the historical exercise power of the each of the historical exercise data sets, and the exercise power and the heart rate ratio corresponding to the $t^{th}$ time point to determine the model coefficients.

8. The method according to claim 1, wherein the exercise heart rate corresponding to the $t^{th}$ time point is measured by the heart rate sensor from the user riding on the bicycle, and after estimating the maximum aerobic power corresponding to the $t^{th}$ time point, the method further comprises:

estimating a functional threshold power of the user based on a plurality of physiological characteristics of the user and the maximum aerobic power corresponding to the $t^{th}$ time point.

9. The method according to claim 8 further comprising:

determining a specific factor based on the functional threshold power and a weight of the user;

in response to determining that the specific factor falls within a predetermined range and that a quantity of the valid exercise data sets is greater than a second predetermined quantity threshold, determining that the functional threshold power is valid;

in response to determining that the specific factor does not fall within the predetermined range or that t is not greater than the predetermined quantity threshold, determining that the functional threshold power is invalid.

10. The method according to claim 8, wherein the physiological characteristics of the user comprises gender, height, and weight.

11. The method according to claim 1, wherein the exercise power corresponding to the $k^{th}$ time point and the exercise power corresponding to the $t^{th}$ time point are pedaling powers applied to the bicycle by the user.

12. An exercise data estimation device comprising:

a storage circuit storing program code;

a processor coupled to the storage circuit;

a heart rate sensor coupled to the processor; and a power meter coupled to the processor;

wherein the processor accesses the program code to:

obtain a plurality of historical exercise data sets corresponding to a first time point to a $t-1^{th}$ time point, wherein a $k^{th}$ historical exercise data set of the historical exercise data sets comprises a historical exercise heart rate and a historical exercise power corresponding to a $k^{th}$ time point, $1 \leq k \leq (t-1)$, and the processor obtains from the heart rate sensor the historical exercise heart rate corresponding to the kth time point measured by the heart rate sensor on the exercise data estimation device worn by a user riding on a bicycle, and obtains the historical exercise power corresponding to the $k^{th}$ time point from the power meter disposed on the bicycle being ridden by the user;

obtain an exercise data set corresponding to a $t^{th}$ time point, wherein the exercise data set corresponding to the $t^{th}$ time point comprises an exercise heart rate and an exercise power corresponding to the $t^{th}$ time point, t is an index value, and the processor obtains from the heart rate sensor the exercise the heart rate corresponding to the $t^{th}$ time point measured by the heart rate sensor on the exercise data estimation device worn by the user riding on the bicycle, and obtains the exercise power corresponding to the $t^{th}$ time point from the power meter disposed on the bicycle being ridden by the user;

determine a heart rate ratio corresponding to the $t^{th}$ time point based on the exercise heart rate corresponding to the $t^{th}$ time point;

in response to determining that t is not less than a first predetermined quantity threshold, estimate a plurality of parameter thresholds based on the historical exercise data sets, determine at least one of a plurality of predetermined conditions based on the plurality of parameter thresholds, and in response to determining that the exercise data set and the heart rate ratio corresponding to the $t^{th}$ time point match the plurality of predetermined conditions, determine that the exercise data set is a valid exercise data set representing that the user is pedaling and riding the bicycle, and update a power estimation model based on the exercise data set and the heart rate ratio corresponding to the $t^{th}$ time point;

in response to determining that t is less than the first predetermined quantity threshold, update the power estimation model based on the exercise data set corresponding to the $t^{th}$ time point, and continue to collect the exercise data set from the heart rate sensor and the power meter for subsequent processing; and estimate a maximum aerobic power corresponding to the $t^{th}$ time point based on the power estimation model.

13. The exercise data estimation device according to claim 12, wherein the exercise power corresponding to the $k^{th}$ time point and the exercise power corresponding to the $t^{th}$ time point are pedaling powers applied to the bicycle by the user.

14. The exercise data estimation device according to claim 12, wherein the parameter thresholds comprise a heart rate ratio statistical value and a power statistical value, and the predetermined conditions comprise one or more of the following conditions:

the heart rate ratio corresponding to the $t^{th}$ time point being greater than the heart rate ratio statistical value and a heart rate ratio lower limit value;

the exercise power corresponding to the $t^{th}$ time point being greater than the power statistical value and a power lower limit value.

15. The exercise data estimation device according to claim 14, wherein the processor accesses the program code to:

determine a predicted exercise power corresponding to the $t^{th}$ time point based on the exercise heart rate corresponding to the $t^{th}$ time point;

obtain a specific error between the exercise power and the predicted exercise power corresponding to the $t^{th}$ time point, wherein the predetermined conditions further comprise:

the specific error being less than an error threshold.

16. The exercise data estimation device according to claim 12, wherein the power estimation model is expressed as:

$$pwr=a*hrr+c$$

where pwr is an estimated power, hrr is a specific heart rate ratio, and a and c are a plurality of model coefficients of the power estimation model.

17. The exercise data estimation device according to claim 16, wherein estimating the maximum aerobic power corresponding to the $t^{th}$ time point based on the power estimation model comprises:

substituting the specific heart rate ratio set as a reference value into the power estimation model, and determining the corresponding estimated power as the maximum aerobic power corresponding to the $t^{th}$ time point.

18. The exercise data estimation device according to claim 16, wherein updating the power estimation model based on the exercise data set and the heart rate ratio corresponding to the $t^{th}$ time point comprises:

updating the model coefficients of the power estimation model based on the exercise data set and the heart rate ratio corresponding to the $t^{th}$ time point.

19. The exercise data estimation device according to claim 18, wherein updating the model coefficients of the power estimation model based on the exercise data set and the heart rate ratio corresponding to the $t^{th}$ time point comprises:

determining a plurality of historical heart rate ratios, wherein the historical heart rate ratios comprise the heart rate ratio corresponding to the historical exercise heart rate of each of the historical exercise data sets;

performing a linear regression operation based on the historical heart rate ratios, the historical exercise power of the each of the historical exercise data sets, and the exercise power and the heart rate ratio corresponding to the $t^{th}$ time point to determine the model coefficients.

20. A non-transitory computer-readable storage medium records an executable computer program, the executable computer program being loaded by an exercise data estimation device comprising a processor, a storage circuit coupled to the processor and storing the executable computer program, a processor coupled to the storage circuit, a heart rate sensor coupled to the processor, and a power meter coupled to the processor, to:

obtain a plurality of historical exercise data sets corresponding to a first time point to a $t-1^{th}$ time point, wherein a $k^{th}$ historical exercise data set of the historical exercise data sets comprises a historical exercise heart rate and a historical exercise power corresponding to a $k^{th}$ time point, $1 \leq k \leq (t-1)$, the historical exercise heart rate corresponding to the kth time point is measured by the heart rate sensor on the exercise data estimation device worn by a user riding on a bicycle and obtained from the heart rate sensor, and the historical exercise power corresponding to the $k^{th}$ time point is obtained from the power meter disposed on the bicycle being ridden by the user;

obtain an exercise data set corresponding to a $t^{th}$ time point, wherein the exercise data set corresponding to the $t^{th}$ time point comprises an exercise heart rate and an exercise power corresponding to the $t^{th}$ time point, t is an index value, the exercise the heart rate corresponding to the $t^{th}$ time point is measured by the heart rate sensor on the exercise data estimation device worn by the user riding on the bicycle and obtained from the heart rate sensor, and the exercise power corresponding to the $t^{th}$ time point is obtained from the power meter disposed on the bicycle being ridden by the user;

determine a heart rate ratio corresponding to the $t^{th}$ time point based on the exercise heart rate corresponding to the $t^{th}$ time point;

in response to determining that t is not less than a first predetermined quantity threshold, estimate a plurality of parameter thresholds based on the historical exercise data sets, determine at least one of a plurality of predetermined conditions based on the plurality of parameter thresholds, and in response to determining that the exercise data set and the heart rate ratio corresponding to the $t^{th}$ time point match the plurality of predetermined conditions, determine that the exercise data set is a valid exercise data set representing that the user is pedaling and riding the bicycle, and update a power estimation model based on the exercise data set and the heart rate ratio corresponding to the $t^{th}$ time point;

in response to determining that t is less than the first predetermined quantity threshold, update the power estimation model based on the exercise data set corresponding to the $t^{th}$ time point, and continue to collect the exercise data set from the heart rate sensor and the power meter for subsequent processing; and estimate a maximum aerobic power corresponding to the $t^{th}$ time point based on the power estimation model.

* * * * *